United States Patent [19]

Stark

[11] 4,156,488

[45] May 29, 1979

[54] CROSS-MEMBER ASSEMBLY

[75] Inventor: Sheldon L. Stark, Eureka, Ill.

[73] Assignee: Caterpillar Tractor Co., Peoria, Ill.

[21] Appl. No.: 816,577

[22] Filed: Jul. 18, 1977

[51] Int. Cl.[2] ..... E02F 3/70

[52] U.S. Cl. ..... 414/697; 29/148.3; 52/731; 228/182

[58] Field of Search ..... 214/140, 145 R, 769; 212/144; 52/721, 731; 180/64 R; 228/182; 29/148.3, 155 C

[56] References Cited

U.S. PATENT DOCUMENTS

| | | | |
|---|---|---|---|
| 2,795,342 | 6/1957 | Steele | 214/140 |
| 3,658,198 | 4/1972 | Keskitalo | 214/140 |
| 3,918,601 | 11/1975 | Zimmerman | 214/140 |
| 3,989,396 | 11/1976 | Matsumoto | 52/721 |

*Primary Examiner*—Francis S. Husar
*Assistant Examiner*—Ross Weaver
*Attorney, Agent, or Firm*—Phillips, Moore, Weissenberger, Lempio & Majestic

[57] ABSTRACT

A cross support assembly is provided which is useful, for example, in earthworking equipment. Such an assembly can be mounted to extend between two lateral supports. A bracket extends laterally from the assembly and can serve as a supportive pivot for a bucket or the like. The assembly is generally hollow and acts as a torsion member. A bulkhead is welded in the cross support assembly and is positioned to directly receive forces exerted on the bracket. Usually the bracket and bulkhead are of unitary construction. The bulkhead extends within a generally tubular cross-member which also forms a part of the assembly and is attached between the lateral supports and into contact with the interior of the tubular member. Forces exerted on the assembly are thus generally compressively applied to the bulkhead welds adding to the overall strength of the assembly.

27 Claims, 5 Drawing Figures

CROSS-MEMBER ASSEMBLY

BACKGROUND OF THE INVENTION

1. Field of the Invention

The invention relates to cross-member assemblies, especially those that are useful in earthworking equipment such as track and tire front loaders and the like.

2. Prior Art

Hollow tubular cross-members attached between parallel lateral supports are known to the art. It is also known to provide brackets which extend from such cross-members and which support pivot points at positions spaced laterally from the cross-members with the pivot support points serving to pivot a tilt lever or the like which controls the tilting of a bucket. Generally, such prior art cross-support assemblies have utilized a one-piece tubular cross-member and the brackets have been attached thereto by welding or otherwise attaching collars about the tubular member with the brackets extending outwardly from the collars. Thus, the prior art has not taught the use of internal gusseting, especially internal gusseting which is integral with the brackets which extend from the prior art cross-support assemblies.

The prior art collars which have attached the brackets to the cross-member have presented a serious problem in that they have extended significantly outwardly about the cross-support assembly and have thereby partially blocked the view of the bucket position as obtained by an operator of a construction vehicle. The prior art structures have also not exhibited sufficient resistance to buckling. Also, the prior art structures have generally required the production of a weld between the collar and the exterior of the generally tubular member and the production of such welds take great skill. Further, even when a skilled operator is producing such welds they may be weak due to poor filling thereof. Yet further, forces exerted on the brackets have been applied to such welds in a tensional, rather than a compressive manner thus increasing the likelihood of weld failure. Any solution to these prior art problems must take into account the fact that the generally tubular cross-member must be hollow in order to be sufficiently twistable to bucket forces which correspond to corner loading of the bucket or the like. In such circumstances the tubular cross-member acts as a torsion member.

SUMMARY OF THE INVENTION

The present invention is directed to overcoming one or more of the problems as set forth above.

According to the present invention there is provided a cross-support assembly comprising a pair of generally parallel lateral supports; a generally tubular cross-member attached between said supports; a bracket extending laterally from a side of said cross-member; and bulkhead means extending within said member and positioned to extend from said bracket and into contact with that portion of the interior thereof thereadjacent.

In another sense the invention relates to a method for assembling a cross-support assembly comprising affixing a channel structure to extend generally fully from a first to a second lateral support; affixing a bulkhead portion of a bulkhead-bracket structure to the concave surface of said channel structure with a bracket portion of said bulkhead-bracket structure extending laterally from said channel structure; affixing a first channel segment to said first lateral support, said channel structure and a first side of said bulkhead-bracket structure; and affixing a second channel segment to said second lateral support, said channel structure and a second side of said bulkhead-bracket structure.

BRIEF DESCRIPTION OF THE DRAWINGS

The invention will be better understood by reference to the figures of the drawings wherein like numbers denote like parts throughout and wherein.

DETAILED DESCRIPTION OF THE PREFERRED EMBODIMENT

Figure 1:
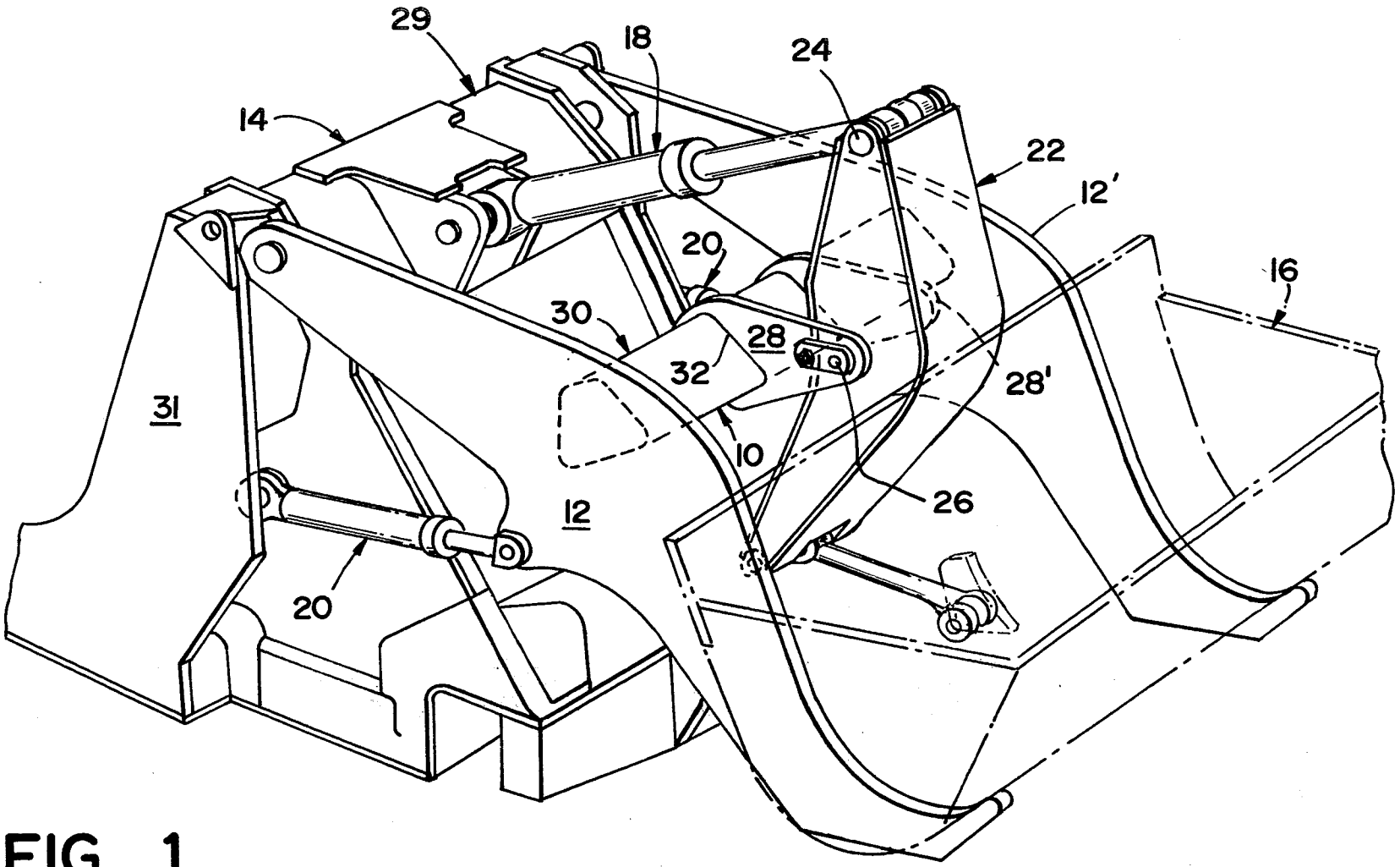
FIG. 1 illustrates, in partial perspective view, a front loader equipped in accordance with the present invention.

Adverting to the figures of the drawings, it will be seen that the present invention relates to a cross-support assembly 10 attached between a pair of generally parallel lateral vertical supports 12, 12'. In the embodiment illustrated the lateral supports 12, 12' are aligned generally vertically and comprise lateral structural members of an earthworking vehicle 14 such as a front loader or the like. The lateral supports 12 and 12' would, for example, comprise the loader arms of the front loader vehicle 14, which loader arms would support a bucket 16 forward of the cross-support assembly 10. In such an assembly expansion and contraction of a first hydraulic motor 18 and a pair of hydraulic motors 20 lead to movement of a bucket tilt lever 22 about its pivotal affixing to the cross-support assembly 10. Briefly, the motor 18 is pivotally attached at a pivot 24 to one end of the tilt lever 22 while the motors 20 act through the lateral supports 12 and and thereby upon the other end of the tilt lever 22. Meanwhile, the tilt lever 22 is intermediately pivoted at a generally horizontal pivot 26 to each of a pair of brackets 28, 28' which form a part of and extends laterally from the cross-support assembly 10.

As an alternative use to extending between the loader arms of the front loader vehicle 14, a similar cross-support assembly 29 is affixed between a pair of generally parallel lateral supports, one of which, 31, is seen in FIG. 1. In this use, the cross support assembly 29 supports one end of the first hydraulic motor 18.

Figure 2:
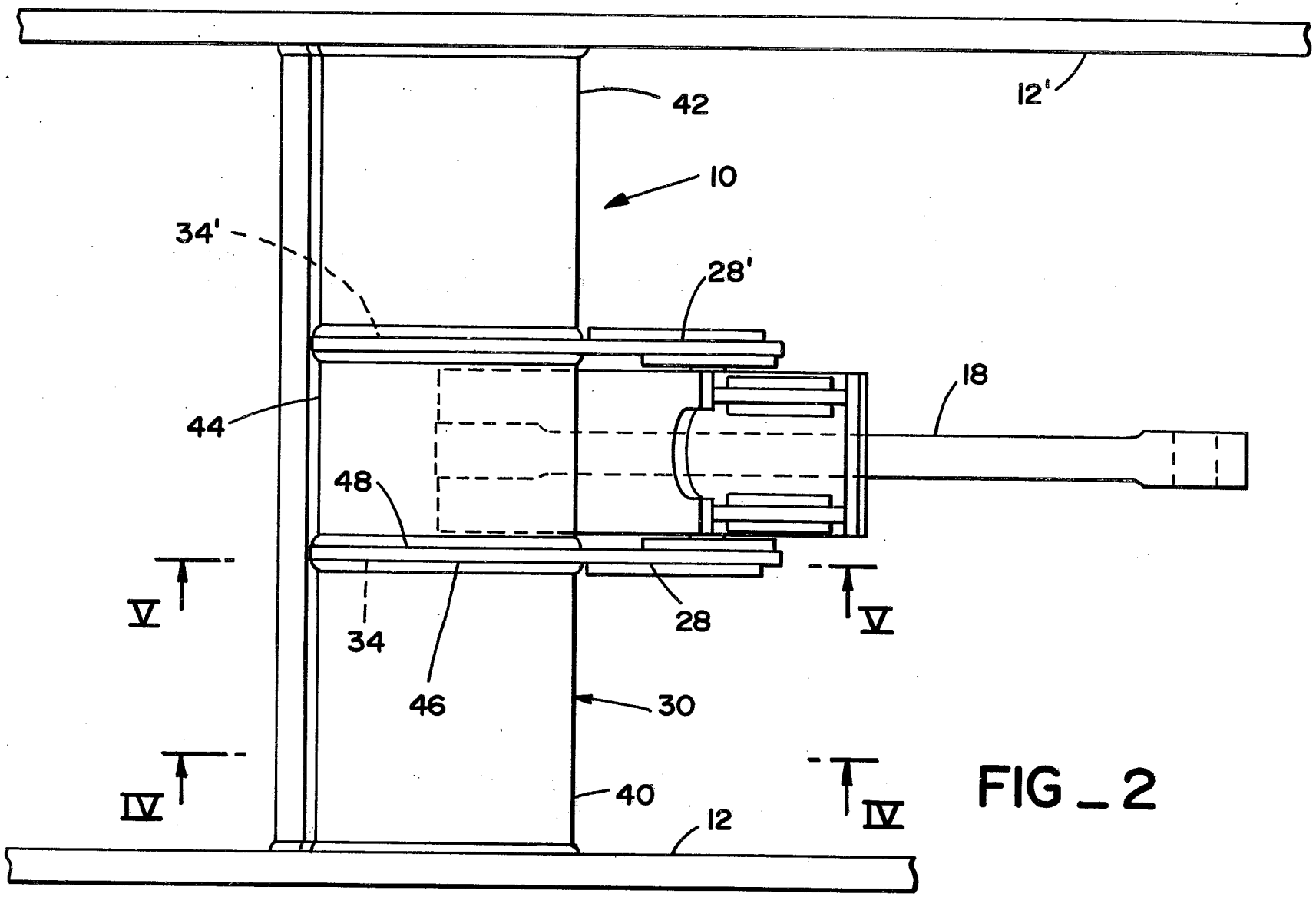
FIG. 2 illustrates in partial plan view, an assembly in accordance with the present invention as attached to portions of a front loading vehicle.
Figure 3:
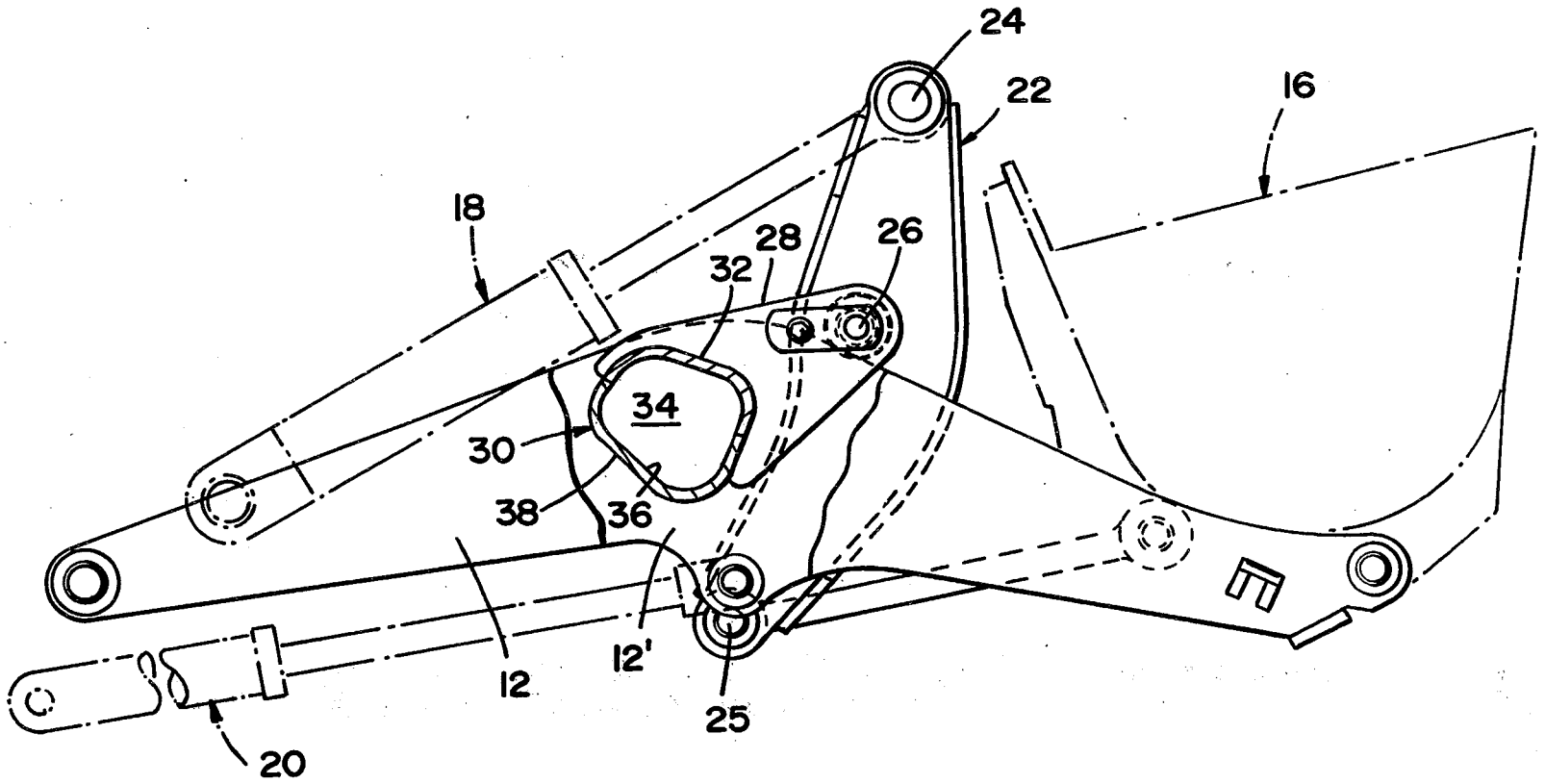
FIG. 3 illustrates in side view, partially broken away, the same structure as is illustrated in FIG. 2.
Figure 4:
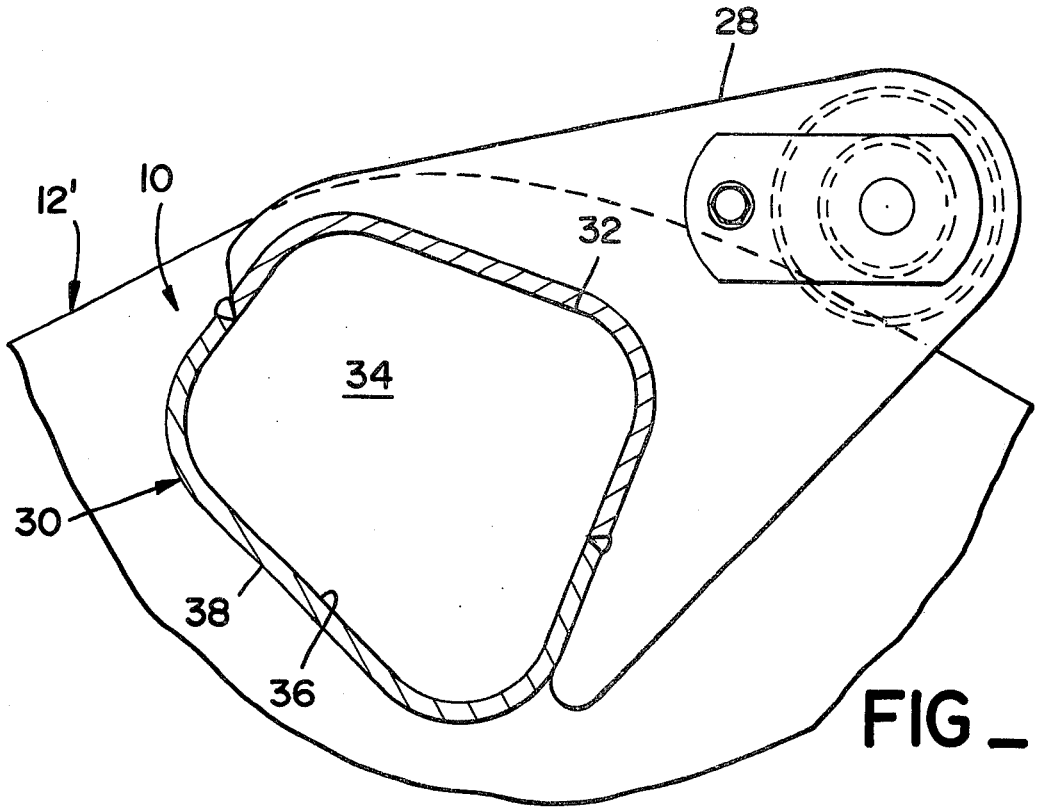
FIG. 4 illustrates a blown up sectional view of a detail in an assembly in accordance with the present invention taken along the line IV—IV of FIG. 2.
Figure 5:
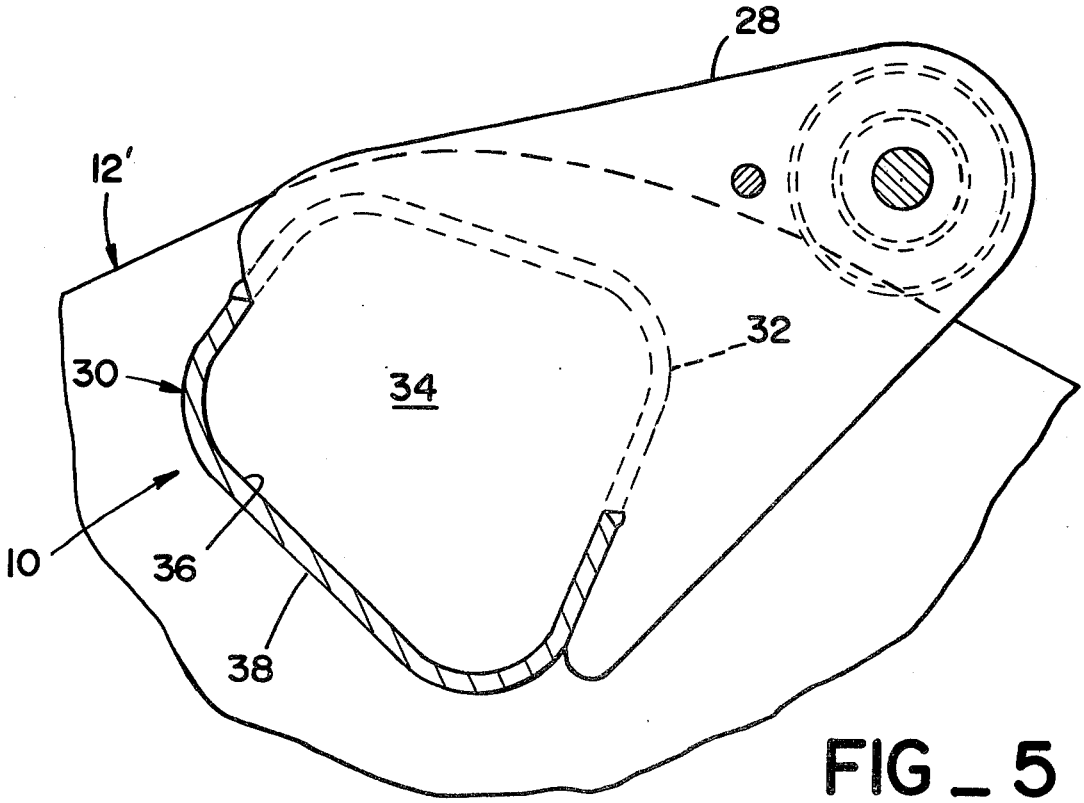
FIG. 5 illustrates in another blown up sectional view, a detail in the structure of an assembly in accordance with the present invention taken along the line V—V of FIG. 2.

Turning now to the structure of the cross-support assembly 10 (which is the same as that of assembly 29), it will be noted that in addition to the pair of generally parallel lateral supports 12, 12', the cross-support assembly 10 comprises a generally tubular cross-member 30 which is attached between the lateral supports 12, 12'. The pivot means 26 is supported by the pairs of brackets 28, 28' and has an axis generally parallel to the axis of the tubular member 30. Thus, forces exerted upon the pivot means 26 are transmitted as torsion and bending forces to the tubular member 30. The brackets 28, 28' extend laterally from a side 32 of the cross-member 30. Bulkhead means, in the embodiment illustrated in FIG. 2 bulkheads 34, 34', are generally unitarily formed as an integral part extending from the brackets 28, 28'. The bulkheads 34, 34' serve as gussets and extend within the tubular member 30 (as best seen in FIG. 5) from the side 32 therefore and into contact with a portion 36 of the interior of the tubular cross-member 30 which is located laterally adjacent to the respective brackets 28, 28'. The bulkhead 34 is generally welded to the portion 36 of the interior of the tubular member 30 to provide a strong and rigid but torsionable structure. The bulkhead 34 provide significant resistance to buckling of the cross-member 30. It is relatively easy to form a weld having good fill with such a structure. Also, forces exerted upon the brackets 28, 28' or elsewhere upon the assembly 10 will be transmitted generally as compressive forces upon such welds whereby the welds are not subjected to heavy tensional loading as might lead to failure thereof.

The tubular cross-member 30 generally comprises a channel structure 38 wich extends generally fully between the lateral supports 12 and 12'. A first channel section 40 extends from the first of the lateral supports 12 to the first of the bulkhead means 34. A second channel section 42 extends from the second of the lateral supports 12' to the second of the bulkhead means 34'. An intermediate channel section 44 extends from the first to the second bulkhead means, namely from 34 to 34'. Each of the channel sections 40, 42 and 44 and the channel structure 38 as well are generally of a hemitubular shape with the understanding that the word hemitubular is used very broadly and is not meant to imply one-half of a tube but rather only a fraction generally thereof. Welds are generally used to affix the channel structure 38 to the first section 40, the second section 42 and the intermediate section 44. Welding is also generally used for affixing the first bulkhead means 34 and the second bulkhead means 34' to the portion 36 of the interior of the tubular cross-member 30. The channel structure 38 when joined with the channel sections 40, 42 and 44 thus form the tubular member 30. Welding is further generally used for affixing the first bulkhead means 34 to the first section 40 and intermediate section 44 and also for affixing the second bulkhead means 34' to the second section 42 and the intermediate section 44. Thus, an overall rigid welded structure results having sufficient torsion for the uneven loads typically encountered with a front bucket loader vehicle or the like. Further, the forces exerted on the welds of the bulkhead means 34 to the portion 36 of the interior of the tubular cross-member 30 are exerted in generally a compressive direction leading to reduced weld failure.

Method

The invention also relates to a method for asembling the cross-support assembly 10. The method comprises affixing, generally by welding, the channel structure 38 to extend generally fully from the first to the second lateral support, 12 to 12'. Then, the bulkhead portion 34, 34' of a bulkhead-bracket structure 34-28, 34'-28' is affixed as by welding to the concave surface of the channel structure 38 with the bracket 28, 28' portion of the bulkhead-bracket structure extending laterally from the channel structure 38. The first channel section 40 is affixed to the first lateral support 12, to the channel structure 38 and to a first side 46 of the bulkhead-bracket structure. Then a second channel section, for example, the second section 42 plus the intermediate section 44, or in the case of a single bulkhead-bracket structure only a second channel section corresponding to the second channel section 42, is affixed generally by welding to the second lateral support 12', the channel structure 38 and a second side 48 of the bulkhead-bracket structure. It is clear that while the above description of the method of the invention relates primarily to the construction of a cross-support assembly 10 having only a single bulkhead-bracket structure, that the steps of the method are also carried out in producing a two, three or more bulkhead-bracket type cross-support assembly 10, for example an assembly as illustrated in the drawings of the present invention.

It will be noted that the cross-support assembly 10 of the present invention is non-solid or hollow by being formed of the generally tubular member 30 and hence can act as a torsion member with sufficient twistability to handle forces upon the bucket 16. Also, the bulkhead means 34, 34' provide significant resistance to buckling of the cross-member 30. Further, it is noted that the welds made in formulating the cross-support assembly 10 of the present invention are easily accessible and are made against surfaces which clearly and easily abut one another whereby weld fill can be adequately attained. Still further, it is clear that through operating in accordance with the present invention the bulkhead-bracket assemblies 34-28, 34'-28', do not extend far out about the generally tubular cross-member 30 and, hence, do not obstruct the operator's view of the bucket 16. Also, the forces exerted on the welds which fasten the bulkhead means 34 to the portion 36 of the interior of the tubular cross-member 30 are exerted in generally a compressive direction leading to reduced weld failure.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The embodiments of the invention in which an exclusive property or privilege is claimed are defined as follows:

1. A cross-support assembly adapted for use with heavy duty equipment such as earthworking vehicles and the like, comprising:
   - a pair of generally parallel lateral supports;
   - a generally tubular cross-member attached between said supports;
   - a bracket extending laterally from a side of said cross-member; and
   - bulkhead means extending within said cross-member and positioned to extend from said bracket and into contact with that portion of the interior of said cross-member adjacent said bracket.

2. An assembly as in claim 1, wherein said generally tubular cross-member comprises:
   - a channel structure extending generally fully between said lateral supports;
   - a first channel section extending from a first of said lateral supports to a position intermediate said lateral supports;

a second channel section extending from a second of said lateral supports to adjacent but short of said position; and means for affixing said structure to said first and second sections.

3. An assembly as in claim 2, wherein said bulkhead means passes between said first and second sections and including:

means for affixing said bulkhead means to said portion of the interior of said member; and means for affixing said bulkhead means to said first and second sections.

4. An assembly as in claim 3, wherein each of said affixing means comprise welds.

5. An assembly as in claim 4, including:

pivot means supported by said bracket and having an axis generally parallel to said member.

6. An assembly as in claim 1, wherein said bulkhead means and said bracket are a unitary structure.

7. An assembly as in claim 1, wherein said lateral supports are aligned generally vertically and comprise lateral structural members of an earthworking vehicle.

8. An assembly as in claim 7, wherein said generally tubular cross-member comprises:

a channel structure extending generally fully between said lateral supports;

a first channel section extending from a first of said lateral supports to a position intermediate said lateral supports;

a second channel section extending from a second of said lateral supports to adjacent but short of said position; and means for affixing said structure to said first and second sections.

9. An assembly as in claim 8, wherein said bulkhead means passes between said first and second sections and including:

means for affixing said bulkhead means to said portion of the interior of said member; and means for affixing said bulkhead means to said first and second sections.

10. An assembly as in claim 8, wherein each of said affixing means comprise welds.

11. An assembly as in claim 10, including:

pivot means supported by said bracket and having an axis generally parallel to said member.

12. An assembly as in claim 1, including:

pivot means supported by said bracket and having an axis generally parallel to said member.

13. An assembly as in claim 12, wherein said generally tubular cross-member comprises:

a channel structure extending generally fully between said lateral supports;

a first channel section extending from a first of said lateral supports to a position intermediate said lateral supports;

a second channel section extending from a second of said lateral supports to adjacent but short of said position; and means for affixing said structure to said first and second sections.

14. An assembly as in claim 13, wherein said bulkhead means passes between said first and second sections and including:

means for affixing said bulkhead means to said portion of the interior of said member; and means for affixing said bulkhead means to said first and second sections.

15. An assembly as in claim 12, wherein said lateral supports are aligned generally vertically and comprise loader arms of a front loader having a bucket forward of said generally tubular member and including:

bucket tilt lever means pivotally affixed to said pivot means; and motor means for pivoting said tilt lever means about said pivot means.

16. An assembly as in claim 15, wherein said generally tubular cross-member comprises:

a channel structure extending generally fully between said lateral supports;

a first channel section extending from a first of said lateral supports to a position intermediate said lateral supports;

a second channel section extending from a second of said lateral supports to adjacent but short of said position; and means for affixing said structure to said first and second sections.

17. An assembly as in claim 16, wherein said bulkhead means passes between said first and second sections and including:

means for affixing said bulkhead means to said portion of the interior of said member; and means for affixing said bulkhead means to said first and second sections.

18. An assembly as in claim 17, wherein each of said affixing means comprise welds.

19. A cross-support assembly adapted for use with heavy duty equipment such as earthworking vehicles and the like, comprising:

a pair of generally parallel lateral supports;

a generally tubular member attached between said supports;

a pair of brackets, each extending laterally from a side of said cross-member to a generally coaxial pivot location having a pivot axis generally parallel to said tubular member; and a pair of bulkhead means, one positioned to extend from each bracket within said member and into contact with that portion of the interior of said cross-member adjacent each of said brackets.

20. An assembly as in claim 19, wherein said generally tubular cross-member comprises:

a channel structure extending generally fully between said lateral supports;

a first channel section extending from a first of said lateral supports to a first of said bulkhead means;

a second channel section extending from a second of said lateral supports to a second of said bulkhead means;

an intermediate channel section extending from said first to said second bulkhead means; and means for affixing said structure to said first, second and intermediate sections.

21. An assembly as in claim 20, including:

means for affixing said first and second bulkhead means to said respective portions of said interior of said member;

means for affixing said first bulkhead means to said first and intermediate sections; and means for affixing said second bulkhead means to said second and intermediate sections.

22. An assembly as in claim 21, wherein each of said affixing means comprise welds.

23. An assembly as in claim 22, wherein said lateral supports are aligned generally vertically and comprise lateral structural members of an earthworking vehicle.

24. An assembly as in claim 22, wherein said lateral supports are aligned generally vertically and comprise loader arms of a front loader having a bucket forward of said generally tubular member and including:

bucket tilt lever means pivotally affixed to said pivot location; and motor means for pivoting said tilt lever means about said pivot location.

25. An assembly as in claim 19, wherein each of said bulkhead means is a unitary structure with a respective one of said brackets.

26. A method for assembling a cross-support assembly of a type adapted for use with heavy duty equipment such as earthworking vehicles and the like, comprising affixing a channel structure to extend generally fully from a first to a second generally parallel lateral support;

affixing a bulkhead portion of a bulkhead-bracket structure to the concave structure of said channel structure with a bracket portion of said bulkhead-bracket structure extending laterally from said channel structure;

affixing a first channel section to said first lateral support, said channel structure and a first side of said bulkhead-bracket structure; and affixing a second channel section to said second lateral support, said channel structure and a second side of said bulkhead-bracket structure.

27. A method as in claim 26, wherein each of said affixing steps comprise welding.

* * * * *